US012799688B2

(12) United States Patent
Yang et al.

(10) Patent No.: US 12,799,688 B2
(45) Date of Patent: Nov. 17, 2026

(54) EXPANSION REINFORCING PLATE AND PAVING METHOD THEREFOR

(71) Applicant: ZHEJIANG JIASHI YIBAO FLOORING CO., LTD, Jiaxing (CN)

(72) Inventors: Feihu Yang, Jiaxing (CN); Xiansheng Cheng, Jiaxing (CN); Jian Sun, Jiaxing (CN); Yong Yu, Jiaxing (CN); Hong Li, Jiaxing (CN); Zhongxun Wang, Jiaxing (CN); Meng Yu, Jiaxing (CN); Lijun Zheng, Jiaxing (CN)

(73) Assignee: ZHEJIANG JIASHI YIBAO FLOORING CO., LTD, Jiaxing (CN)

( * ) Notice: Subject to any disclaimer, the term of this patent is extended or adjusted under 35 U.S.C. 154(b) by 159 days.

(21) Appl. No.: 18/707,684

(22) PCT Filed: Nov. 3, 2022

(86) PCT No.: PCT/CN2022/129638
§ 371 (c)(1),
(2) Date: May 6, 2024

(87) PCT Pub. No.: WO2023/078368
PCT Pub. Date: May 11, 2023

(65) Prior Publication Data

US 2025/0003226 A1 Jan. 2, 2025

(30) Foreign Application Priority Data

Nov. 4, 2021 (CN) ..... 202111300811.X

(51) Int. Cl.
*E01D 19/06* (2006.01)
*E01C 11/10* (2006.01)
(Continued)

(52) U.S. Cl.
CPC ..... *E01D 19/06* (2013.01); *E01C 11/106* (2013.01); *E01C 11/126* (2013.01); *E02D 31/04* (2013.01);
(Continued)

(58) Field of Classification Search
CPC ..... E01C 11/106; E01C 11/126; E01D 19/06; E02D 31/04; E04F 15/02005; E04F 15/02016
See application file for complete search history.

(56) References Cited

U.S. PATENT DOCUMENTS 2,370,153 A * 2/1945 Fischer ..... E01C 11/126 404/64
2,431,384 A * 11/1947 Fischer ..... E04B 1/6812 524/925
(Continued)

FOREIGN PATENT DOCUMENTS

CN 100999953 A 7/2007
CN 101886464 A 11/2010
(Continued)

*Primary Examiner* — Jessie T Fonseca
(74) *Attorney, Agent, or Firm* — NKL Law; Allen Xue

(57) ABSTRACT

An expansion reinforcing plate has plates and an elastic inserting strip assembling structure. The elastic inserting strip assembling structure includes expansion reinforcing connecting strips A (1), expansion reinforcing connecting strips B (2) and expansion reinforcing connecting strip assembling groove structures (3). The expansion reinforcing connecting strips A (1) are inserted into the expansion reinforcing connecting strip assembling groove structures (3) of two adjacent plates. The expansion reinforcing connecting strips A (1) of every two adjacent plates are jointly connected with the expansion reinforcing connecting strips B (2). The expansion reinforcing connecting strips B (2) make contact with the expansion reinforcing connecting strips A (1) on the two sides for reaction, so that the
(Continued)

expansion reinforcing connecting strips A (1) and the expansion reinforcing connecting strips B (2) expand and are fixedly connected, and then the two adjacent plates are effectively connected.

8 Claims, 11 Drawing Sheets

(51) Int. Cl.
*E01C 11/12* (2006.01)
*E02D 31/04* (2006.01)
*E04F 15/02* (2006.01)

(52) U.S. Cl.
CPC ..... *E04F 15/02005* (2013.01); *E04F 15/02016* (2013.01)

(56) References Cited

U.S. PATENT DOCUMENTS 3,023,681 A * 3/1962 Worson ..... E01C 11/106 404/49
3,434,401 A * 3/1969 Kiewit ..... E02B 3/16 404/65
3,504,597 A * 4/1970 Pare ..... E01C 11/126 404/69
3,595,142 A * 7/1971 Via ..... E01D 19/06 404/49
3,598,026 A * 8/1971 Johnson ..... E01D 19/06 404/49
3,888,599 A * 6/1975 Reifsnyder ..... E01D 19/06 404/69
4,148,167 A * 4/1979 Puccio ..... E04B 1/681 404/69
4,179,226 A * 12/1979 Puccio ..... E01C 11/126 404/69
RE31,283 E * 6/1983 Puccio ..... E01C 11/126 49/498.1
4,637,085 A * 1/1987 Hartkorn ..... E01D 19/06 404/66
4,743,139 A * 5/1988 Spavin ..... E01D 19/06 404/69
4,896,994 A * 1/1990 Brown ..... E01D 19/06 404/64
5,035,533 A * 7/1991 Brown ..... E01D 19/06 404/64
2005/0066600 A1* 3/2005 Moulton ..... E01D 19/06 52/393
2009/0107077 A1* 4/2009 Zhang ..... E04F 15/02005 52/588.1
2016/0060880 A1* 3/2016 Stover ..... E04F 15/02044 52/582.2
2019/0266335 A1* 8/2019 Robinson ..... H04L 9/08
2019/0383026 A1* 12/2019 Bergelin ..... E04F 15/02016
2020/0279046 A1* 9/2020 Robinson ..... E04B 1/6812

FOREIGN PATENT DOCUMENTS

CN 103603473 A 2/2014
CN 105507108 A * 4/2016 ..... E01C 11/02
CN 108316136 A * 7/2018 ..... E01D 19/06
CN 108330822 A * 7/2018 ..... E01D 19/083
CN 207846696 U 9/2018
CN 108914767 A * 11/2018 ..... E01D 19/06
CN 110105902 A 8/2019
CN 209603183 U 11/2019
CN 210947571 U 7/2020
CN 212336580 U 1/2021
CN 213038781 U 4/2021
CN 113389349 A 9/2021
GB 2093885 A * 9/1982 ..... E01D 19/06
GB 2416797 A * 2/2006 ..... E04B 1/68
JP 2007327177 A 12/2007
KR 20140020175 A 2/2014

* cited by examiner

EXPANSION REINFORCING PLATE AND PAVING METHOD THEREFOR

TECHNICAL FIELD

The present invention relates to the technical field of plate, in particular to an expansion reinforcing plate and a paving method therefor.

BACKGROUND ART

Plate products have increasingly broad applications in the market, and have the advantages of environmental protection, skid resistance, wear resistance, deformation resistance and convenient paving. It is a kind of decorative products having a good development prospect. Traditional plate paving adopts direct splicing method, which has the problems such as easy to produce abnormal sound when step on the plates, easy water seepage and poor moisture resistance, and has great limitations in use. In terms of the traditional plate paving, there is still a problem of insufficient splicing strength, which heavily affects the use performance and aesthetics of the plates. In terms of the assembly process, traditional plates have problems such as complicated operation which affecting the installation efficiency of the plates, high precision requirements for slotting treatment and high cost.

SUMMARY

The present invention provides an expansion reinforcing plate and a paving method thereof according to the problems aforementioned that the traditional plate paving adopts direct splicing method, which has the problems such as easy to produce abnormal sound when step on the plates, easy water seepage and poor moisture resistance, and has great limitations in use; in terms of the traditional plate paving, there is still a problem of insufficient splicing strength, which heavily affects the use performance and aesthetics of the plates; in terms of the assembly process, traditional plates have problems such as complicated operation which affecting the installation efficiency of the plates, high precision requirements for slotting treatment and high cost. The present invention mainly uses that the expansion reinforcing connecting strips A of every two adjacent plates are connected with the expansion reinforcing connection strip B, the expansion reinforcing connecting strip B is in contact with and reacts with the expansion reinforcing connecting strips A on both sides thereof to enable the expansion reinforcing connecting strips A and the expansion reinforcing connecting strip B to expand to fixedly connect with each other, so that the every two adjacent plates are effectively connected.

Technical solutions adopted by the present invention are as follows:

An expansion reinforcing plate includes plates and an elastic inserting strip assembling structure for connecting adjacent plates. The elastic inserting strip assembling structure includes an expansion reinforcing connecting strip A, an expansion reinforcing connecting strip B and an expansion reinforcing connecting strip assembling groove structure. The expansion reinforcing connecting strip assembling groove structure is disposed at an edge of each of every two adjacent plates, and the expansion reinforcing connecting strip A is disposed in the expansion reinforcing connecting strip assembling groove structure of each of the every two adjacent plates. Both the expansion reinforcing connecting strips A of the every two adjacent plates are connected with the expansion reinforcing connecting strip B. The expansion reinforcing connecting strip B is in contact with and reacts with the expansion reinforcing connecting strips A on both sides thereof to enable the expansion reinforcing connecting strips A and the expansion reinforcing connecting strip B expand and fixedly connect with each other, so that the every two adjacent plates are effectively connected.

Each of the expansion reinforcing connecting strip A and the expansion reinforcing connecting strip B is produced by a special formula through a one-time extrusion process.

Further, the formula of the expansion reinforcing connecting strip A includes 15-35 wt. % of low viscosity epoxy resin, 5-20 wt. % of active diluent, 35-60 wt. % of polyepoxy acrylate resin, and 10-25 wt. % of modified polyacrylic acid resin. The low viscosity epoxy resin is at least one of E-54 bisphenol A epoxy resin, E-51 bisphenol A epoxy resin and REF170 bisphenol F epoxy resin with a viscosity lower than 1 Pa·s.

Further, the production process of the expansion reinforcing connecting strip A includes adding 15-35 wt. % of low viscosity epoxy resin, 30-50 wt. % of polyepoxy acrylate resin and 5-35 wt. % modified polyacrylic acid resin into 5-20 wt. % of active diluent to obtain a mixture, then preheating and mixing the mixture at 110-135° C., and then cold mixing the mixture at 35-50° C., followed by extruding the mixed mixture into a flexible connecting strip A with a certain shape at 165-210° C. by using a single screw extruder to obtain the expansion reinforcing connecting strip A.

Further, the formula of the expansion reinforcing connecting strip B includes 15-35 wt. % of polyamine, 50-70 wt. % of modified polyacrylic acid resin, 5-25 wt. % of low viscosity epoxy resin, 5-15 wt. % of active diluent, and 5-20 wt. % of ethyl acetate. The low viscosity epoxy resin is at least one of E-54 bisphenol A epoxy resin, E-51 bisphenol A epoxy resin and REF170 bisphenol F epoxy resin with a viscosity lower than 1 Pa·s.

Further, the production process of the expansion reinforcing connecting strip B includes preheating and mixing 15-35 wt. % of polyamine, 50-70 wt. % of modified polyacrylic acid resin, 5-25 wt. % of low viscosity epoxy resin, 5-15 wt. % of active diluent and 5-20 wt. % of ethyl acetate at 110-135° C. to obtain a mixture, and then cold mixing the mixture at 35-50° C., followed by extruding the mixed mixture into a flexible connecting strip B with a certain shape at 150-200° C. by using a single screw extruder to obtain the expansion reinforcing connecting strip B.

Further, the expansion reinforcing connecting strip A has a rectangular structure, a circular structure or a special-shaped structure. A length a1 of the rectangular structure is 2-25 mm and a width h1 is 0.5-10 mm. A diameter R1 of the circular structure is 2-15 mm. An outer edge length c1 of the special-shaped structure is 2-25 mm and a width h2 is 0.5-10 mm.

Further, the expansion reinforcing connecting strip B has a rectangular structure, an oblong structure or a special-shaped structure. A length d1 of the rectangular structure is 2-25 mm and a width e1 is 0.5-10 mm. A length d2 of the oblong structure is 2-25 mm and a width e2 is 0.5-10 mm. A length d3 of the special-shaped structure is 2-25 mm and a width e3 is 0.5-9 mm.

Further, the expansion reinforcing connecting strip assembling groove structure has a U-shaped structure, a dovetail-shaped structure or a special-shaped structure. A length f1 of the U-shaped structure is 2-20 mm and a width g1 is 0.5-8 mm. A length f2 of the dovetail-shaped structure is 2-20 mm and a width g2 at an opening is 0.5-8 mm. A length f3 of the special-shaped structure is 2-20 mm and a width g3 at an opening is 0.5-8 mm.

The present invention further provides a method for paving the expansion reinforcing plates, including the following steps:

During the paving of the expansion reinforcing plates, firstly, place the expansion reinforcing connecting strip A into the expansion reinforcing connecting strip assembling groove structure of each of the adjacent plates, at this time, there is a gap between the expansion reinforcing connecting strip A and the expansion reinforcing connecting strip assembling groove structure. Then, when paving, insert the expansion reinforcing connecting strip B into the expansion reinforcing connecting strip assembling groove structures of the adjacent plates at the same time. Both sides of the expansion reinforcing connecting strip B (2) are contacted with the expansion reinforcing connecting strips A (1) which are firstly placed into the adjacent plates. After a certain time, each the expansion reinforcing connecting strip A and the expansion reinforcing connecting strips B expand to fix with each other, and each the expansion reinforcing connecting strip A expands to closely contact with an inner wall of the expansion reinforcing connecting strip assembling groove structure adjacent thereto, so that the adjacent plates can be effectively spliced by the expansion reinforcing connecting strip assembling groove structures and the expansion reinforcing connecting strips, and finally, enable the expansion reinforcing connecting strips to expand and fix with each other through the contact between the expansion reinforcing connecting strips A and the expansion reinforcing connecting strip B, thereby effectively connecting the every two adjacent plates.

Further, an operation time in the contact process of the expansion reinforcing connecting strip A and the expansion reinforcing connecting strip B is 2-10 minutes for basic curing, and the expansion reinforcing connecting strips reach a final use strength after 12-36 hours.

Compared with the prior art, the present invention has the following beneficial effects:

1. Beautiful Product Appearance

The expansion reinforcing plate product of the present invention has beautiful appearance and is decorative.

2. Good Production Formula of the Product

The production formulas of the expansion reinforcing strips of the expansion reinforcing plates have reasonable ratio, good performance, which can well meet the use requirements.

3. Fine Production Process of the Product

The production process of the expansion reinforcing strips of the expansion reinforcing plate has reasonable parameters, convenient production, which can well meet the production requirements.

4. Comfortable Feeling on Foot when Step on the Plates after Paving

The expansion reinforcing plate product of the present invention has comfortable feeling on foot when step on it after paving by using the special expansion reinforcing connecting strips to effectively connect every two adjacent plates.

5. Long Service Life of the Product

The expansion reinforcing plate product of the present invention has a long overall service life.

6. High Strength of the Product after Paving

The method for paving the expansion reinforcing plates can make every two adjacent plates closely bonded and have high paving strength, which can well meet the use requirements.

7. Good and Convenient Method for Paving

The expansion reinforcing plates and the production paving method thereof have convenient installation process and high paving efficiency, which can well meet the use requirements.

8. Wide Range of Applications

The present invention is scientific and reasonable, and can be applied to various plate products, providing a wide range of applications.

9. High Comprehensive Cost Performance

The expansion reinforcing plates and the production paving method thereof have a high comprehensive cost performance, which is conducive to its popularity or popularization, and improve the market space of the plates.

In summary, the technical solutions of the present invention can solve the problems that the traditional plate paving using the direct splicing method is easy to produce abnormal sound when step on the plates and occur water seepage, and has poor moisture resistance great limitations in use. The present invention can also solve the problems of insufficient splicing strength, which heavily affects the use performance and aesthetics of the plates in terms of the traditional plate paving, and the problems such as, in terms of the assembly process, complicated operation which affecting the installation efficiency of the plates, high precision requirements for slotting treatment and high cost.

Based on the above reasons, the present invention can be widely promoted in the fields using the plate products such as doors and windows, architecture, decoration and the like.

BRIEF DESCRIPTION OF THE DRAWINGS

In order to more clearly illustrate the technical solution in the embodiment of the present invention or the prior art, the following is a brief introduction of the accompanying drawings required to be used in the description of the embodiment or the prior art. Obviously, the accompanying drawings in the description below are some embodiments of the present invention. For those ordinary in the art, other accompanying drawings can also be obtained from these accompanying drawings without creative labor.

FIGS. 1A-1C show structural schematic diagrams of the expansion reinforcing connecting strip A of the present invention, wherein FIG. 1A shows a rectangular structure, FIG. 1B shows a circular structure, and FIG. 1C shows a special-shaped structure.

FIGS. 2A-2C show structural schematic diagrams of the expansion reinforcing connecting strip B of the present invention, wherein FIG. 2A shows a rectangular structure, FIG. 2B shows an oblong structure, and FIG. 2C shows a special-shaped structure.

FIGS. 3A-3C show structural schematic diagrams of the expansion reinforcing connection strip assembling groove structure of the present invention, wherein FIG. 3A shows a U-shaped structure, FIG. 3B shows a dovetail-shaped structure, and FIG. 3C show a special-shaped structure.

FIGS. 4A-4C show structural schematic diagrams of that the expansion reinforcing connection strip assembling groove structure is a U-shaped structure and the expansion reinforcing connecting strip B is a rectangular structure in Example 1 of the present invention, wherein FIG. 4A shows the expansion reinforcing connecting strip A with a circular structure, FIG. 4B shows the expansion reinforcing connecting strip A with a rectangular structure, and FIG. 4C shows the expansion reinforcing connecting strip A with a special-shaped structure.

FIGS. 5A-5C show structural schematic diagrams of that the expansion reinforcing connection strip assembling groove structure is a U-shaped structure and the expansion reinforcing connecting strip B is an oblong structure in Example 2 of the present invention, wherein FIG. 5A shows the expansion reinforcing connecting strip A with a circular structure, FIG. 5B shows the expansion reinforcing connecting strip A with a rectangular structure, and FIG. 5C shows the expansion reinforcing connecting strip A with a special-shaped structure.

FIGS. 6A-6C show structural schematic diagrams of that the expansion reinforcing connection strip assembling groove structure is a U-shaped structure and the expansion reinforcing connecting strip B is a special-shaped structure in Example 3 of the present invention, wherein FIG. 6A shows the expansion reinforcing connecting strip A with a circular structure, FIG. 6B shows the expansion reinforcing connecting strip A with a rectangular structure, and FIG. 6C shows the expansion reinforcing connecting strip A with a special-shaped structure.

FIGS. 7A-7C show structural schematic diagrams of that the expansion reinforcing connection strip assembling groove structure is a dovetail-shaped structure and the expansion reinforcing connecting strip B is a rectangular structure in Example 4 of the present invention, wherein FIG. 7A shows the expansion reinforcing connecting strip A with a circular structure, FIG. 7B shows the expansion reinforcing connecting strip A with a rectangular structure, and FIG. 7C shows the expansion reinforcing connecting strip A with a special-shaped structure.

FIGS. 8A-8C show structural schematic diagrams of that the expansion reinforcing connection strip assembling groove structure is a dovetail-shaped structure and the expansion reinforcing connecting strip B is an oblong structure in Example 5 of the present invention, wherein, FIG. 8A shows the expansion reinforcing connecting strip A with a circular structure, FIG. 8B shows the expansion reinforcing connecting strip A with a rectangular structure, and FIG. 8C shows the expansion reinforcing connecting strip A with a special-shaped structure.

FIGS. 9A-9C show structural schematic diagrams of that the expansion reinforcing connection strip assembling groove structure is a dovetail-shaped structure and the expansion reinforcing connecting strip B is a special-shaped structure in Example 6 of the present invention, wherein FIG. 9A shows the expansion reinforcing connecting strip A with a circular structure, FIG. 9B shows the expansion reinforcing connecting strip A with a rectangular structure, and FIG. 9C shows the expansion reinforcing connecting strip A with a special-shaped structure.

FIGS. 10A-10C show structural schematic diagrams of that the expansion reinforcing connection strip assembling groove structure is a special-shaped structure and the expansion reinforcing connecting strip B is a rectangular structure in Example 7 of the present invention, wherein FIG. 10A shows the expansion reinforcing connecting strip A with a circular structure, FIG. 10B shows the expansion reinforcing connecting strip A with a rectangular structure, and FIG. 10C shows the expansion reinforcing connecting strip A with a special-shaped structure.

FIGS. 11A-11C show structural schematic diagrams of that the expansion reinforcing connection strip assembling groove structure is a special-shaped structure and the expansion reinforcing connecting strip B is an oblong structure in Example 8 of the present invention, wherein FIG. 11A shows the expansion reinforcing connecting strip A with a circular structure, FIG. 11B shows the expansion reinforcing connecting strip A with a rectangular structure, and FIG. 11C shows the expansion reinforcing connecting strip A with a special-shaped structure.

FIGS. 12A-12C show structural schematic diagrams of that the expansion reinforcing connection strip assembling groove structure is a special-shaped structure and the expansion reinforcing connecting strip B is a special-shaped structure in Example 9 of the present invention, wherein FIG. 12A shows the expansion reinforcing connecting strip A with a circular structure, FIG. 12B shows the expansion reinforcing connecting strip A with a rectangular structure, and FIG. 12C shows the expansion reinforcing connecting strip A with a special-shaped structure.

Figure 1A:
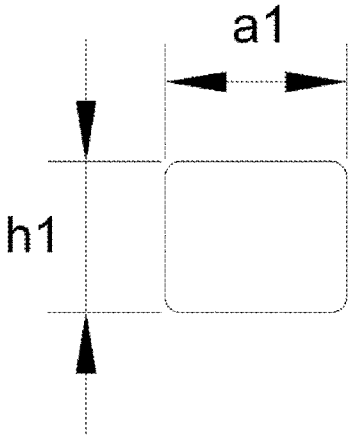
Figure 1B:
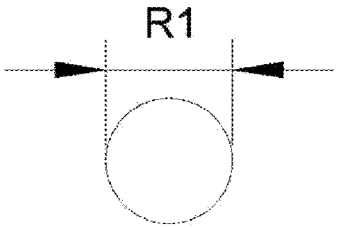
Figure 1C:
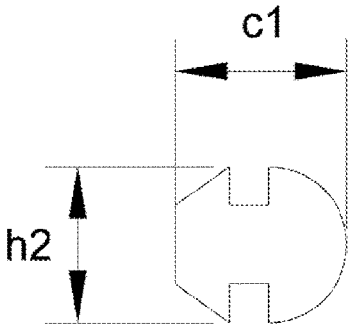
Figure 2A:
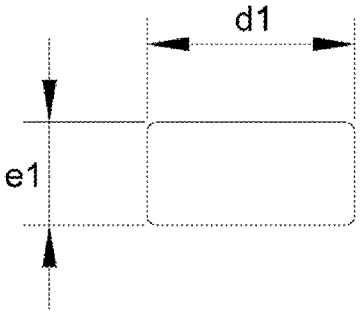
Figure 2B:
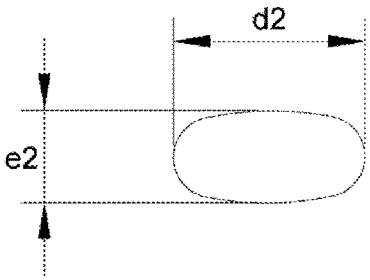
Figure 2C:
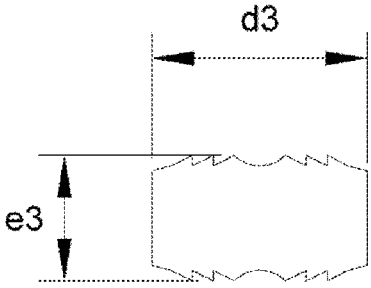
Figure 3A:
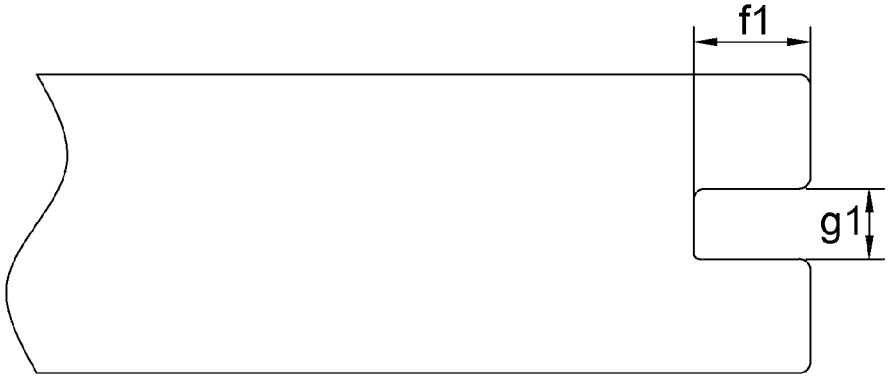
Figure 3B:
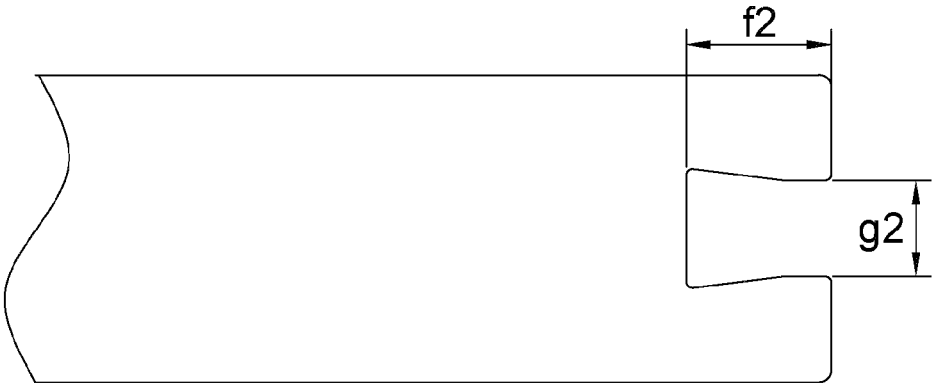
Figure 3C:
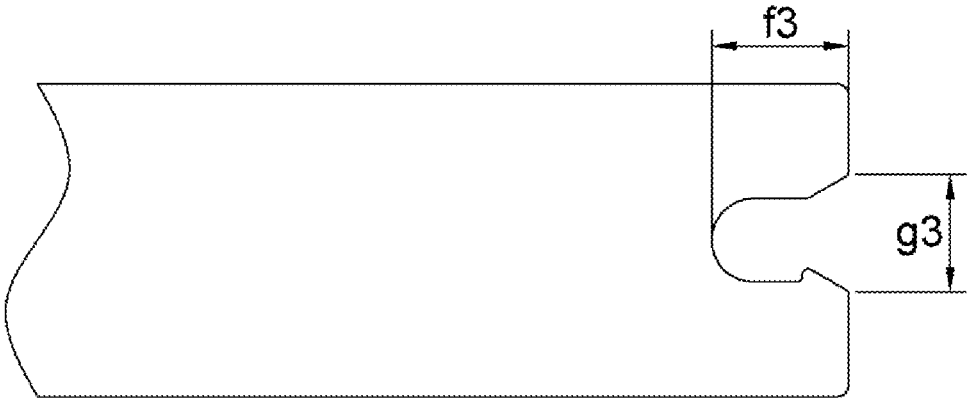

In the figures, 1—expansion reinforcing connecting strip A, 2—expansion reinforcing connecting strip B, 3—expansion reinforcing connection strip assembling groove structure, 4—plate I, 5—plate II.

DETAILED DESCRIPTION OF THE EMBODIMENTS

It should be noted that, in the case of no conflicts, the embodiments and the features in the embodiments of the present invention can be combined mutually. The present invention will be described in detail below with reference to the accompanying drawings and the embodiments.

To make the objectives, technical solutions and advantages of embodiments of the present invention more obvious, the technical solutions of the present invention will be clearly and completely described below in conjunction with the accompanying drawings in the embodiments of the present invention, and obviously, the described embodiments are some, rather than all of the embodiments of the present invention. The following description of at least one example embodiment is merely illustrative in nature, and is in no way intended to limit the present invention, an application or use thereof. Based on the embodiments of the present invention, all other embodiments acquired by those ordinary skilled in the art without making creative efforts fall within the scope of protection of the present invention.

It should be noted that the terms used herein are only intended to describe specific embodiments and are not intended to limit the example embodiments of the present invention. As used herein, unless indicated obviously in the context, a singular form is also intended to include a plural form. In addition, it should also be understood that the terms "include" and/or "comprise" used in this specification indicate features, steps, operations, devices, components and/or their combinations.

Except as otherwise specifically set forth, the relative arrangement of components and steps, numerical expressions and numerical values set forth in these embodiments do not limit the scope of the present invention. In addition, it should be clear that, for ease of description, sizes of the various components shown in the accompanying drawings are not drawn according to actual proportional relationships. Technologies, methods, and devices known to those of ordinary skill in the relevant fields may not be discussed in detail, but where appropriate, the technologies, methods, and devices should be considered as a part of the authorization specification. In all the examples shown and discussed herein, any specific value should be interpreted as merely example rather than limiting. Therefore, other examples of the example embodiments may have different values. It should be noted that similar reference signs and letters represent similar items in the accompanying drawings below. Therefore, once an item is defined in one accompanying drawing, the item does not need to be further discussed in a subsequent accompanying drawing.

As shown in figures, the present invention provides an expansion reinforcing plate, belonging to a building plate material. The expansion reinforcing plate includes plates and an elastic inserting strip assembling structure for connecting adjacent plates. The elastic inserting strip assembling structure includes an expansion reinforcing connecting strip A1 and an expansion reinforcing connecting strip B2 that are disposed in an expansion reinforcing connecting strip assembling groove structure 3. The expansion reinforcing connecting strip assembling groove structure 3 is disposed at an edge of each of every two adjacent plates, and the expansion reinforcing connecting strip A1 is disposed in the expansion reinforcing connecting strip assembling groove structure 3 of each of the every two adjacent plates. Both the expansion reinforcing connecting strips A1 of the every two adjacent plates are connected with the expansion reinforcing connecting strip B2, the expansion reinforcing connecting strip B2 is in contact with and reacts with the expansion reinforcing connecting strips A1 on both sides to enable the expansion reinforcing connecting strips A1 and the expansion reinforcing connecting strip B2 to expand and fixedly connect with each other, so that every two adjacent plates are effectively connected.

Each of the expansion reinforcing connecting strip A1 and the expansion reinforcing connecting strip B2 is produced by a special formula through a one-time extrusion process.

As a preferred implementation, the formula of the expansion reinforcing connecting strip A1 comprises 15-35 wt. % of low viscosity epoxy resin, 5-20 wt. % of active diluent, 35-60 wt. % of polyepoxy acrylate resin, and 10-25 wt. % of modified polyacrylic acid resin. The low viscosity epoxy resin is at least one of E-54 bisphenol A epoxy resin, E-51 bisphenol A epoxy resin and REF170 bisphenol F epoxy resin with a viscosity lower than 1 Pa·s.

As a preferred implementation, the production process of the expansion reinforcing connecting strip A1 comprises adding 15-35 wt. % of low viscosity epoxy resin, 30-50 wt. % of polyepoxy acrylate resin and 5-35 wt. % modified polyacrylic acid resin into 5-20 wt. % of active diluent to obtain a mixture, then preheating and mixing the mixture at 110-135° C., and then cold mixing the mixture at 35-50° C., followed by extruding the mixed mixture into a flexible connecting strip A with a certain shape at 165-210° C. by using a single screw extruder to obtain expansion reinforcing connecting strip A1.

As a preferred implementation, the formula of the expansion reinforcing connecting strip B2 comprises 15-35 wt. % of polyamine, 50-70 wt. % of modified polyacrylic acid resin, 5-25 wt. % of low viscosity epoxy resin, 5-15 wt. % of active diluent, and 5-20 wt. % of ethyl acetate. The low viscosity epoxy resin is at least one of E-54 bisphenol A epoxy resin, E-51 bisphenol A epoxy resin and REF170 bisphenol F epoxy resin with a viscosity lower than 1 Pa·s.

As a preferred implementation, the production process of the expansion reinforcing connecting strip B2 comprises preheating and mixing 15-35 wt. % of polyamine, 50-70 wt. % of organosilicone modified polyacrylic acid resin, 5-25 wt. % of low viscosity epoxy resin, 5-15 wt. % of active diluent and 5-20 wt. % of ethyl acetate at 110-135° C. to obtain a mixture, and then cold mixing the mixture at 35-50° C., followed by extruding the mixed mixture into a flexible connecting strip B with a certain shape at 150-200° C. by using a single screw extruder.

The active diluent of the present invention can be but not limited to low molecular weight epoxy compounds containing epoxy groups, which is mainly used as a part of crosslinked network structure of the cured product. The modified polyacrylate resin of the present invention plays a curing role, including but not limited to silicone modified polyacrylate resin. The low viscosity epoxy resin of the present invention acts as a curing bond. The polyamine of the present invention plays a role of curing, including but not limited to thiourea modified polyamine.

As a preferred implementation, the expansion reinforcing connecting strip A1 has a rectangular structure, a circular structure or a special-shaped structure (i.e., an irregular structure), that is, the cross-sectional shape of the expansion reinforcing connecting strip A1 is rectangular, circular or special-shaped correspondingly. A length a1 of the rectangular structure is 2-25 mm and a width h1 is 0.5-10 mm. A diameter R1 of the circular structure is 2-15 mm. A maximum length c1 of an outer edge of the special-shaped structure is 2-25 mm and a maximum width h2 is 0.5-10 mm.

As a preferred implementation, the expansion reinforcing connecting strip B2 has a rectangular structure, an oblong structure or a special-shaped structure (i.e., an irregular structure), that is, the cross-sectional shape of the expansion reinforcing connecting strip B2 is rectangular, oblong or special-shaped correspondingly. A length d1 of the rectangular structure is 2-25 mm and a width e1 is 0.5-10 mm. A length d2 of the oblong structure is 2-25 mm and a width e2 is 0.5-10 mm. A length d3 of the special-shaped structure is 2-25 mm and a width e3 is 0.5-9 mm.

As a preferred implementation, the expansion reinforcing connecting strip assembling groove structure 3 has a U-shaped structure, a dovetail-shaped structure or a special-shaped structure (i.e., an irregular structure), that is, the cross-sectional shape of the expansion reinforcing connecting strip assembling groove structure 3 is U-shaped, swallowtail or special-shaped correspondingly. A length f1 of the U-shaped structure is 2-20 mm and a width g1 is 0.5-8 mm. A length f2 of the dovetail-shaped structure is 2-20 mm and a width g2 at an opening is 0.5-8 mm. A length f3 of the special-shaped structure is 2-20 mm and a width g3 at an opening is 0.5-8 mm.

The present invention further provides a method for paving the expansion reinforcing plate, including the following steps:

During the paving of the expansion reinforcing plates, firstly, place the expansion reinforcing connecting strip A1 into the expansion reinforcing connecting strip assembling groove structure 3 of each of the adjacent plates, at this time, there is a gap between the expansion reinforcing connecting strip A1 and the expansion reinforcing connecting strip assembling groove structure 3. Then, when paving, insert the expansion reinforcing connecting strip B2 into the expansion reinforcing connecting strip assembling groove structures of the adjacent plates at the same time. Both sides of the expansion reinforcing connecting strip B2 are contacted with the expansion reinforcing connecting strips A1 which are firstly placed into the adjacent plates. After a certain time, each the expansion reinforcing connecting strip A1 and the expansion reinforcing connecting strips B2 expand and fix with each other, and each the expansion reinforcing connecting strip A1 expands to closely contact with an inner wall of the expansion reinforcing connecting strip assembling groove structure 3, so that the adjacent plates can be effectively spliced by the expansion reinforcing connecting strip assembling groove structures 3 and the expansion reinforcing connecting strips, and finally, enable the expansion reinforcing connecting strips to expand to fix with each other through the contact between the expansion reinforcing connecting strips A1 and the expansion reinforcing connecting strip B2, thereby effectively connecting the adjacent plates.

As a preferred implementation, an operation time in the contact process of the expansion reinforcing connecting strips A1 and the expansion reinforcing connecting strips B2 is 2-10 minutes for basic curing, and the expansion reinforcing strips reach a final use strength after 12-36 hours.

Example 1

Figure 4A:
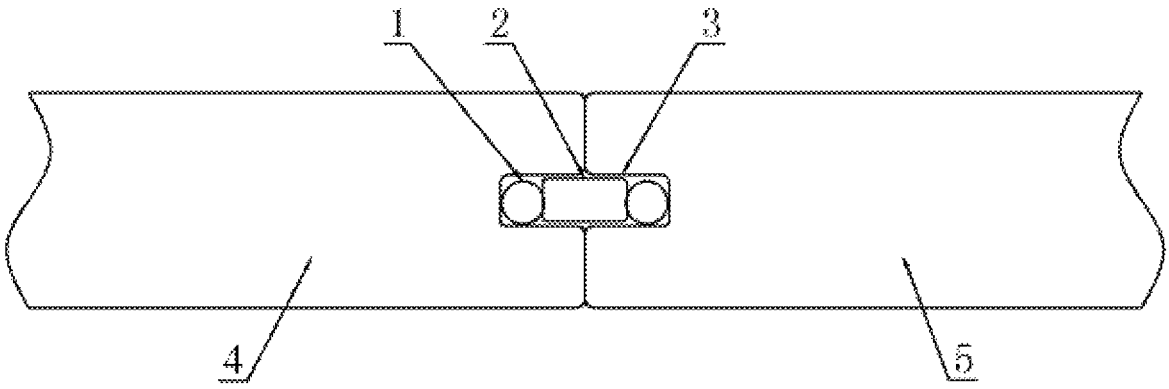
Figure 4B:
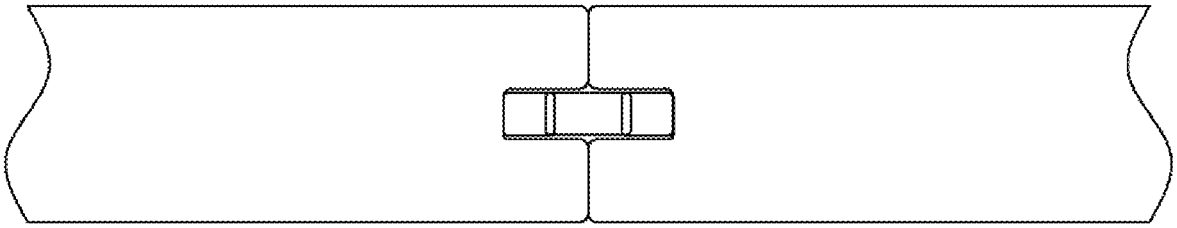
Figure 4C:
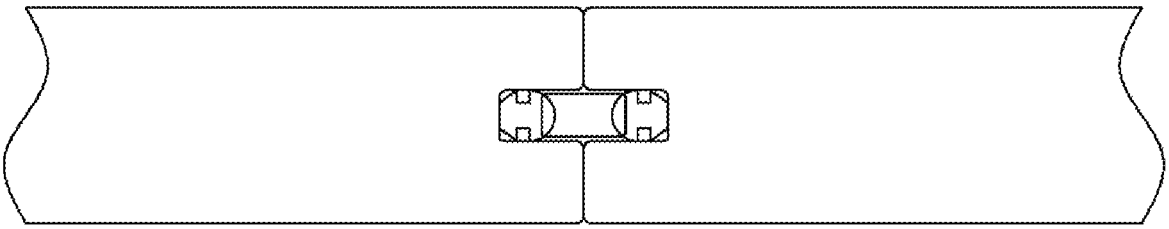

As shown in FIGS. 4A-4C, an expansion reinforcing plate mainly includes a plate and a plate paving foundation layer, and further includes an elastic inserting strip assembling structure disposed at the edge of the plate. The elastic inserting strip assembling structure includes a special expansion reinforcing connecting strip A, a special expansion reinforcing connecting strip B and a special expansion reinforcing connecting strip assembling groove structure of the plate. The special expansion reinforcing connecting strip of the plate is produced by a special formula through a one-time extrusion process. When paving the expansion reinforcing plates, the special expansion reinforcing connecting strip A is firstly placed in the special expansion reinforcing connecting strip assembling groove structure of each of the adjacent plates. When the paving continues, the special expansion reinforcing connecting strip B is pre-inserted into the special expansion reinforcing connecting strip assembling groove structures of the plates. The adjacent plates are effectively spliced through the special expansion reinforcing connecting strip assembling groove structures and the special expansion reinforcing connecting strips. Finally, the expansion reinforcing connecting strips are fixed with each other through the contact and expansion between the expansion reinforcing connecting strips A and the expansion reinforcing connecting strip B, so that the adjacent plates are effectively connected.

The formula of the special expansion reinforcing connecting strip A included:

27 wt. % of low viscosity epoxy resin, 12 wt. % of active diluent, 36 wt. % of polyepoxy acrylate resin, and 25 wt. % of modified polyacrylic acid resin.

The production process of the special expansion reinforcing connecting strip A included the following steps:

The materials in the formula were pre-heated and mixed at 125° C., and then were cold mixed at 45° C. to obtain a mixture. The mixed mixture was extruded at 175° C. by using a single screw extruder into a flexible connecting strip A with a certain shape.

The formula of the special expansion reinforcing connecting strip B included:

21 wt. % of polyamine, 40 wt. % of modified polyacrylic acid resin, 18 wt. % of low viscosity epoxy resin, 11 wt. % of active diluent, and 10 wt. % of ethyl acetate.

The production process of the special expansion reinforcing connecting strip B included the following steps:

Various materials in the formula were pre-heated and mixed at 118° C., and then were cold mixed at 40° C. to obtain a mixture. The mixed mixture was extruded at 161° C. by using a single screw extruder into a flexible connecting strip B with a certain shape.

In the example, the special expansion reinforcing connecting strip assembling groove structure is a U-shaped structure, and the special expansion reinforcing connecting strip B is a rectangle structure. Details are as follows:

As shown in FIG. 4A, the cross-section of the special expansion reinforcing connecting strip A is a circular structure with a diameter of 5 mm, the cross-section of the special expansion reinforcing connecting strip B is a rectangular structure with a length of 10 mm or 13 mm and a width of 4 mm or 5 mm, and the special expansion reinforcing connecting strip assembling groove structure is a U-shaped structure with a length of 6 mm and a width at the opening of the U-shape of 4.5 mm.

As shown in FIG. 4B, the cross-section of the special expansion reinforcing connecting strip A is a rectangle structure with a length of 5 mm and a width of 4 mm, the cross-section of the special expansion reinforcing connecting strip B is a rectangular structure with a length of 2 mm and a width of 0.5 mm, and the special expansion reinforcing connecting strip assembling groove structure is a U-shaped structure with a length of 2 mm and a width at the opening of the U-shape of 0.5 mm.

As shown in FIG. 4C, the cross-section of the special expansion reinforcing connecting strip A is an irregular structure (i.e., a special-shaped structure) with a maximum size of its outer edge as follows: a maximum length c1 of 2-25 mm and a maximum width of 0.5-10 mm, the cross-section of the special expansion reinforcing connecting strip B is a rectangular structure with a length of 25 mm and a width of 10 mm, and the special expansion reinforcing connecting strip assembling groove structure is a U-shaped structure with a length of 11 mm and a width of 4.5 mm.

Two adjacent plates are plate I 4 and plate II 5 respectively. When paving the expansion reinforcing plates, the special expansion reinforcing connecting assembling groove structure of each of the plate I 4 and the plate II 5 is inserted with a special expansion reinforcing connecting strip A. When continue paving, the special expansion reinforcing connecting strip B is pre-inserted into the special expansion reinforcing connecting strip assembling groove structure of one plate, and the adjacent another plate is effectively spliced with the previous one through its special expansion reinforcing connecting strip assembling groove structure and special expansion reinforcing connecting strip. Finally, both the expansion reinforcing connecting strips A of the adjacent plates contact with the expansion reinforcing connecting strip B to expand and fix with each other, so that the two adjacent plates are effectively connected. The operation time for expansion and fixation after the contact between the expansion reinforcing connecting strip A and the expansion reinforcing connecting strip B is 6 minutes for basic curing, which reaches the final use strength after 24 hours. The tensile strength is 1.8 kN/m.

Example 2

Figure 5A:
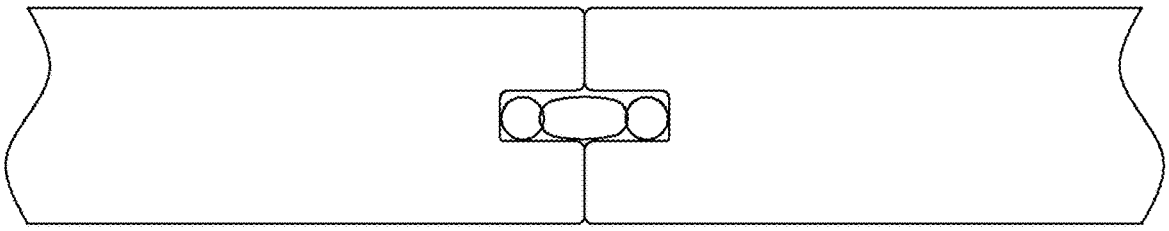
Figure 5B:
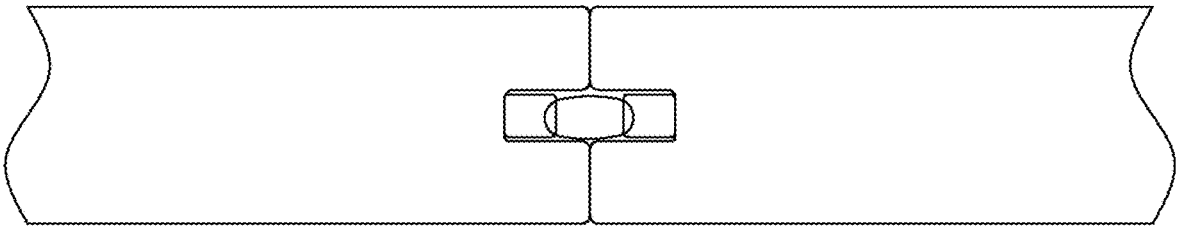
Figure 5C:
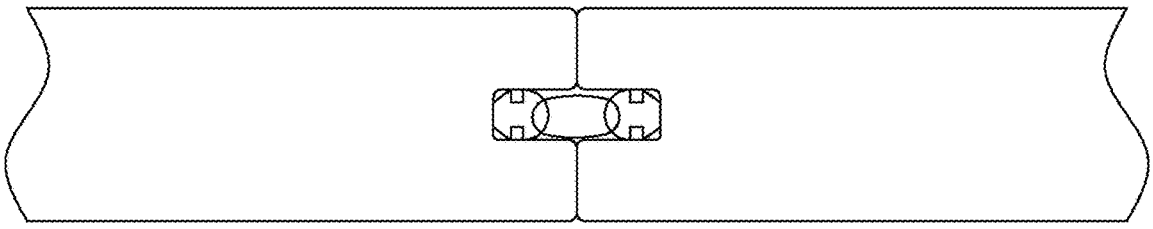

As shown in FIGS. 5A-5C, different from Example 1, in the example, an expansion reinforcing plate mainly includes a plate and a plate paving foundation layer, and further including an elastic inserting strip assembling structure. The elastic inserting strip assembling structure includes a special expansion reinforcing connecting strip A, a special expansion reinforcing connecting strip B and a special expansion reinforcing connecting strip assembling groove structure disposed at the plate. The elastic inserting strip assembling structure is disposed at the edge of the plate.

The formula of the special expansion reinforcing connecting strip A included:

27 wt. % of low viscosity epoxy resin, 12 wt. % of active diluent, 36 wt. % of polyepoxy acrylate resin, and 25 wt. % of polyacrylic acid resin.

The production process of the special expansion reinforcing connecting strip A included the following steps:

Various materials in the formula were pre-heated and mixed at 125° C., and then were cold mixed at 45° C. to obtain a mixture. The mixed mixture was extruded at 175° C. by using a single screw extruder into a flexible connecting strip A with a certain shape.

The formula of the special expansion reinforcing connecting strip B included:

19 wt. % of polyamine, 45 wt. % of polyacrylic acid resin, 15 wt. % of low viscosity epoxy resin, 11 wt. % of active diluent, and 10 wt. % of ethyl acetate.

The production process of the special expansion reinforcing connecting strip B included the following steps:

Various materials in the formula were pre-heated and mixed at 118° C., and then were cold mixed at 40° C. to obtain a mixture. The mixed mixture was extruded at 161° C. by using a single screw extruder into a flexible connecting strip B with a certain shape.

In the example, the special expansion reinforcing connecting strip assembling groove structure is a U-shaped structure with a length of 2-20 mm and a width of 0.5-8 mm, and the special expansion reinforcing connecting strip B is an oblong structure with a length of 2-25 mm and a width of 0.5-10 mm. Specifically, as shown in FIG. 5A, the cross-section of the special expansion reinforcing connecting strip A is a circular structure with a diameter of 2-15 mm. Different from FIG. 5A, as shown in FIG. 5B, the cross-section of the special expansion reinforcing connecting strip A is a rectangular structure with a length of 2-25 mm and a width of 0.5-10 mm. Different from FIG. 5A, as shown in FIG. 5C, the cross-section of the special expansion reinforcing connecting strip A is an irregular structure, and a maximum size of the outer edge of the irregular structure is as follows: a maximum length c1 of 2-25 mm and a maximum width of 0.5-10 mm.

When paving the expansion reinforcing plates, the special expansion reinforcing connecting strip A is firstly placed in the special expansion reinforcing connecting strip assembling groove structure of each of the plates. When continue paving, the special expansion reinforcing connecting strip B is pre-inserted into the special expansion reinforcing connecting strip assembling groove structure of one plate, and the adjacent another plate is effectively spliced with the previous one through its special expansion reinforcing connecting strip assembling groove structure and special expansion reinforcing connecting strip. Finally, both the expansion reinforcing connecting strips A of the adjacent plates contact with the expansion reinforcing connecting strip B to expand and fix with each other, so that the two adjacent plates are effectively connected. The operation time for expansion and fixation after the contact between the expansion reinforcing connecting strip A and the expansion reinforcing connecting strip B is 6 minutes for basic curing, which reaches the final use strength after 24 hours. The tensile strength is 1.2 kN/m.

Example 3

Figure 6A:
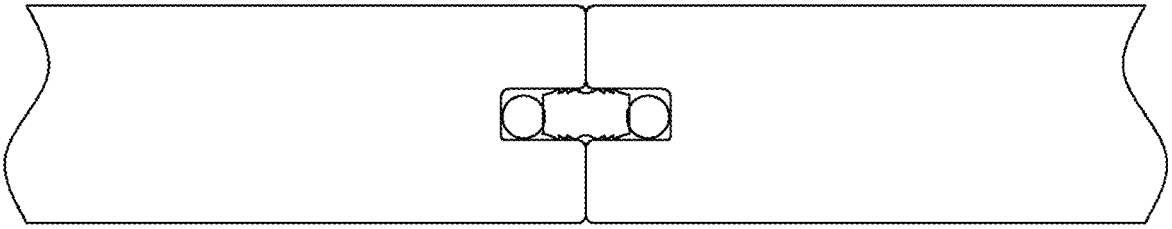
Figure 6B:
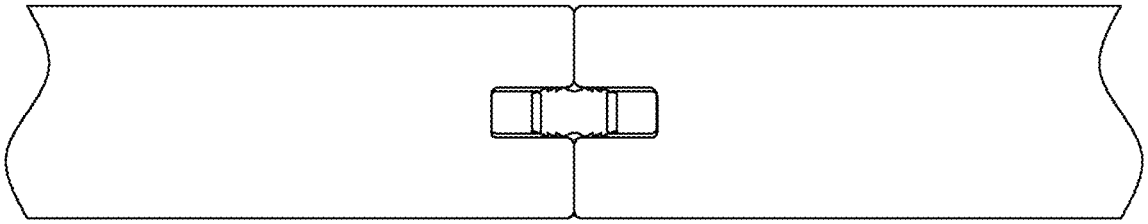
Figure 6C:
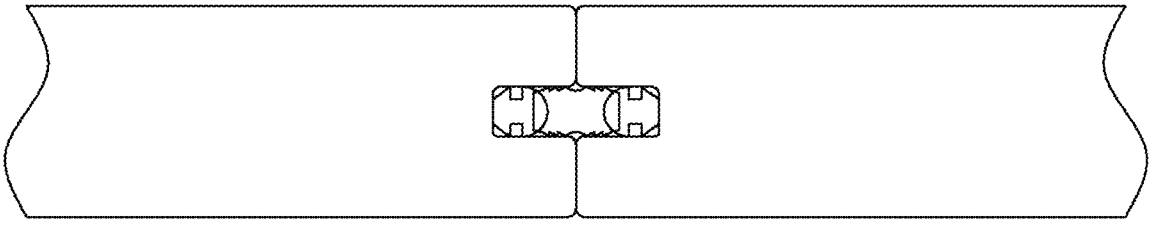

As shown in FIGS. 6A-6C, different from Example 1, in the example, an expansion reinforcing plate mainly includes a plate and a plate paving foundation layer, and further includes an elastic inserting strip assembling structure. The elastic inserting strip assembling structure includes a special expansion reinforcing connecting strip A, a special expansion reinforcing connecting strip B and a special expansion reinforcing connecting strip assembling groove structure disposed at the plate. The elastic inserting strip assembling structure is disposed at the edge of the plate.

The formula of the special expansion reinforcing connecting strip A included:

27 wt. % of low viscosity epoxy resin, 13 wt. % of active diluent, 35 wt. % of polyepoxy acrylate resin, and 25 wt. % of modified polyacrylic acid resin.

The production process of the special expansion reinforcing connecting strip A included the following steps:

Various materials in the formula were pre-heated and mixed at 125° C., and then were cold mixed at 45° C. to obtain a mixture. The mixed mixture was extruded at 175° C. by using a single screw extruder into a flexible connecting strip A with a certain shape.

The formula of the special expansion reinforcing connecting strip B included:

19 wt. % of polyamine, 45 wt. % of modified polyacrylic acid resin, 17 wt. % of low viscosity epoxy resin, 11 wt. % of active diluent, and 8 wt. % of ethyl acetate.

The production process of the special expansion reinforcing connecting strip B included the following steps:

Various materials in the formula were pre-heated and mixed at 118° C., and then were cold mixed at 40° C. to obtain a mixture. The mixed mixture was extruded at 161° C. by using a single screw extruder into a flexible connecting strip B with a certain shape.

In the example, the special expansion reinforcing connecting strip assembling groove structure is a U-shaped structure with a length of 20 mm and a width of 8 mm, and the special expansion reinforcing connecting strip B is an irregular structure (i.e., special-shaped structure) with a length of 2-25 mm and a width of 0.5-9 mm. Specifically, as shown in FIG. 6A, the cross-section of the special expansion reinforcing connecting strip A is a circular structure with a diameter of 2-15 mm. Different from FIG. 6A, as shown in FIG. 6B, the cross-section of the special expansion reinforcing connecting strip A is a rectangular structure with a length of 2-25 mm and a width of 0.5-10 mm. Different from FIG. 6A, as shown in FIG. 6C, the cross-section of the special expansion reinforcing connecting strip A is an irregular structure, and a maximum size of the outer edge of the irregular structure is as follows: a maximum length c1 of 2-25 mm and a maximum width of 0.5-10 mm.

When paving the expansion reinforcing plates, the special expansion reinforcing connecting strip A is firstly placed in the special expansion reinforcing connecting strip assembling groove structure of each of the plates. When continue paving, the special expansion reinforcing connecting strip B is pre-inserted into the special expansion reinforcing connecting strip assembling groove structure of one plate, and the adjacent another plate is effectively spliced with the previous one through its special expansion reinforcing connecting strip assembling groove structure and special expansion reinforcing connecting strip. Finally, both the expansion reinforcing connecting strips A of the adjacent plates contact with the expansion reinforcing connecting strip B to expand and fix with each other, so that the two adjacent plates are effectively connected. The operation time for expansion and fixation after the contact between the expansion reinforcing connecting strip A and the expansion reinforcing connecting strip B is 6 minutes for basic curing, which reaches the final use strength after 24 hours. The tensile strength is 2.2 kN/m.

Example 4

Figure 7A:
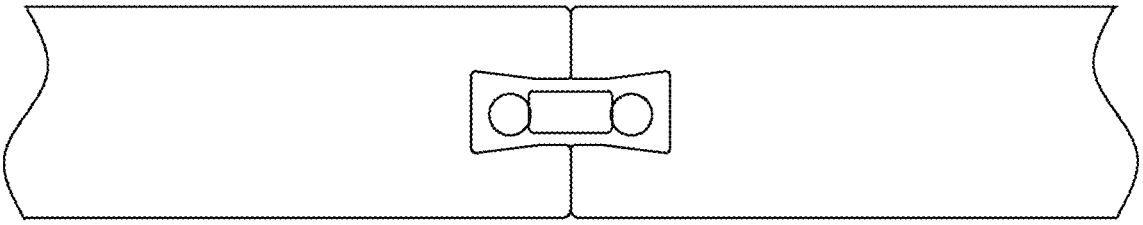
Figure 7B:
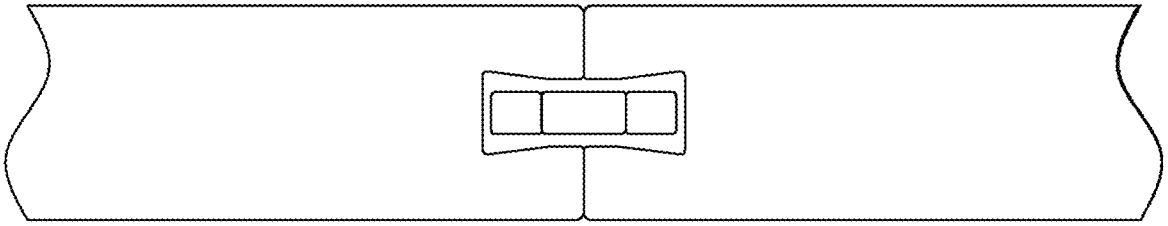
Figure 7C:
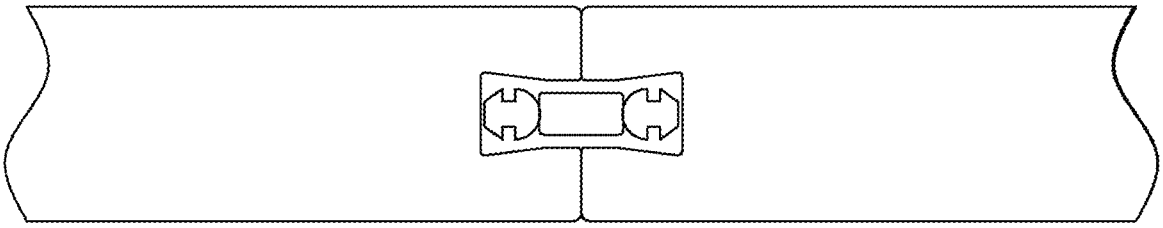

As shown in FIGS. 7A-7C, different from Example 1, in the example, an expansion reinforcing plate mainly includes a plate and a plate paving foundation layer, and further includes an elastic inserting strip assembling structure. The elastic inserting strip assembling structure includes a special expansion reinforcing connecting strip A, a special expansion reinforcing connecting strip B and a special expansion reinforcing connecting strip assembling groove structure disposed at the plate. The elastic inserting strip assembling structure is disposed at the edge of the plate.

The formula of the special expansion reinforcing connecting strip A included:

27 wt. % of low viscosity epoxy resin, 12 wt. % of active diluent, 41 wt. % of polyepoxy acrylate resin, and 20 wt. % of modified polyacrylic acid resin.

The production process of the special expansion reinforcing connecting strip A included the following steps:

Various materials in the formula were pre-heated and mixed at 125° C., and then were cold mixed at 45° C. to obtain a mixture. The mixed mixture was extruded at 175° C. by using a single screw extruder into a flexible connecting strip A with a certain shape.

The formula of the special expansion reinforcing connecting strip B included:

15 wt. % of polyamine, 40 wt. % of modified polyacrylic acid resin, 24 wt. % of low viscosity epoxy resin, 11 wt. % of active diluent, and 10 wt. % of ethyl acetate.

The production process of the special expansion reinforcing connecting strip B included the following steps:

Various materials in the formula were pre-heated and mixed at 118° C., and then were cold mixed at 40° C. to obtain a mixture. The mixed mixture was extruded at 161° C. by using a single screw extruder into a flexible connecting strip B with a certain shape.

In the example, the special expansion reinforcing connecting strip assembling groove structure is a dovetail-shaped structure with a length of 2 mm and a width at the opening of the dovetail-shaped structure of 0.5 mm, and the special expansion reinforcing connecting strip B is a rectangle structure with a length of 2 mm and a width of 0.5 mm. Specifically, as shown in FIG. 7A, the cross-section of the special expansion reinforcing connecting strip A is a circular structure with a diameter of 2-15 mm. Different from FIG. 7A, as shown in FIG. 7B, the cross-section of the special expansion reinforcing connecting strip A is a rectangular structure with a length of 2-25 mm and a width of 0.5-10 mm. Different from FIG. 7A, as shown in FIG. 7C, the cross-section of the special expansion reinforcing connecting strip A is an irregular structure, and a maximum size of the outer edge of the irregular structure is as follows: a maximum length c1 of 2-25 mm and a maximum width of 0.5-10 mm.

When paving the expansion reinforcing plates, the special expansion reinforcing connecting strip A is firstly placed in the special expansion reinforcing connecting strip assembling groove structure of each of the plates. When continue paving, the special expansion reinforcing connecting strip B is pre-inserted into the special expansion reinforcing connecting strip assembling groove structure of one plate, and the adjacent another plate is effectively spliced with the previous one through its special expansion reinforcing connecting strip assembling groove structure and special expansion reinforcing connecting strip. Finally, both the expansion reinforcing connecting strips A of the adjacent plates contact with the expansion reinforcing connecting strip B to expand and fix with each other, so that the two adjacent plates are effectively connected. The operation time for expansion and fixation after the contact between the expansion reinforcing connecting strip A and the expansion reinforcing connecting strip B is 6 minutes for basic curing, which reaches the final use strength after 28 hours. The tensile strength is 2.6 kN/m.

Example 5

Figure 8A:
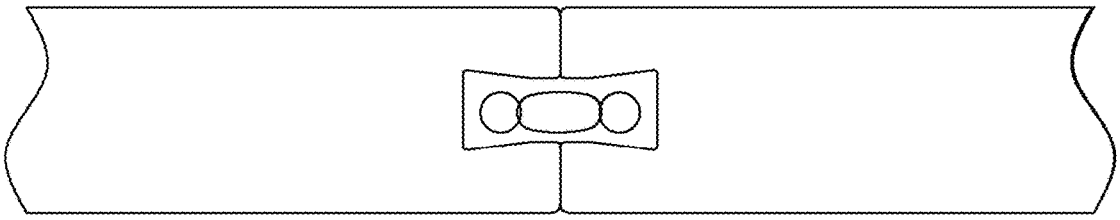
Figure 8B:
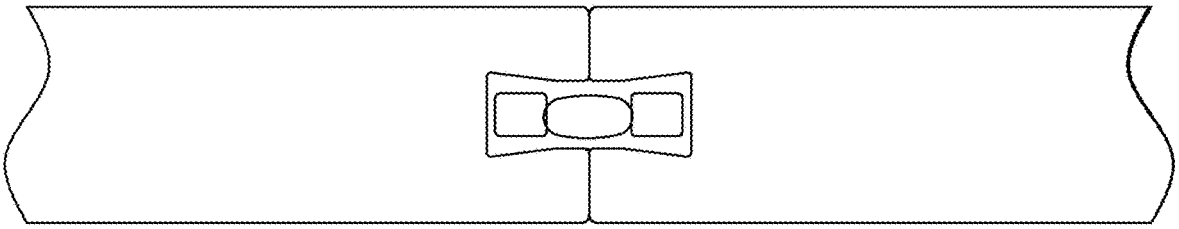
Figure 8C:
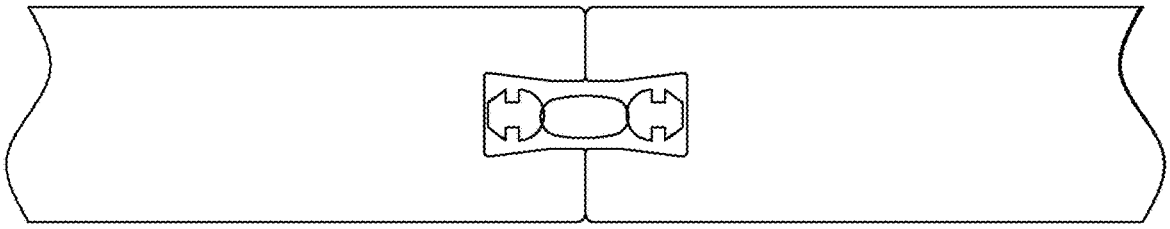

As shown in FIGS. 8A-8C, different from Example 1, in the example, an expansion reinforcing plate mainly includes a plate and a plate paving foundation layer, and further includes an elastic inserting strip assembling structure. The elastic inserting strip assembling structure includes a special expansion reinforcing connecting strip A, a special expansion reinforcing connecting strip B and a special expansion reinforcing connecting strip assembling groove structure disposed at the plate. The elastic inserting strip assembling structure is disposed at the edge of the plate.

The formula of the special expansion reinforcing connecting strip A includes:

27 wt. % of low viscosity epoxy resin, 12 wt. % of active diluent, 36 wt. % of polyepoxy acrylate resin, and 25 wt. % of modified polyacrylic acid resin.

The production process of the special expansion reinforcing connecting strip A included the following steps:

Various materials in the formula were pre-heated and mixed at 125° C., and then were cold mixed at 45° C. to obtain a mixture. The mixed mixture was extruded at 175° C. by using a single screw extruder into a flexible connecting strip A with a certain shape.

The formula of the special expansion reinforcing connecting strip B included:

26 wt. % of polyamine, 48 wt. % of modified polyacrylic acid resin, 6 wt. % of low viscosity epoxy resin, 11 wt. % of active diluent, and 9 wt. % of ethyl acetate.

The production process of the special expansion reinforcing connecting strip B included the following steps:

Various materials in the formula were pre-heated and mixed at 118° C., and then were cold mixed at 40° C. to obtain a mixture. The mixed mixture was extruded at 161° C. by using a single screw extruder into a flexible connecting strip B with a certain shape.

In the example, the special expansion reinforcing connecting strip assembling groove structure is a dovetail-shaped structure, and the special expansion reinforcing connecting strip B is a rectangle structure. Details are as follows:

As shown in FIG. 8A, the cross-section of the special expansion reinforcing connecting strip A is a circular structure with a diameter of 2.5 mm, the cross-section of the special expansion reinforcing connecting strip B is an oblong structure with a length of 5 mm and a width of 2 mm, and the special expansion reinforcing connecting strip assembling groove structure is a dovetail-shaped structure with a length of 11 mm and a width at the opening of the dovetail-shaped structure of 4 mm.

As shown in FIG. 8B, the cross-section of the special expansion reinforcing connecting strip A is a rectangle structure with a length of 3 mm and a width of 2 mm, the cross-section of the special expansion reinforcing connecting strip B is an oblong structure with a length of 5 mm and a width of 2 mm, and the special expansion reinforcing connecting strip assembling groove structure is a dovetail-shaped structure with a length of 3 mm and a width at the opening of the dovetail-shaped structure of 2 mm.

As shown in FIG. 8C, the cross-section of the special expansion reinforcing connecting strip A is an irregular structure (i.e., a special-shaped structure) with a maximum size of its outer edge as follows: a maximum length of 2 mm and a maximum width of 3 mm, the cross-section of the special expansion reinforcing connecting strip B is a rectangular structure with a length of 5 mm and a width of 2 mm, and the special expansion reinforcing connecting strip assembling groove structure is a dovetail-shaped structure with a length of 3 mm and a width at the opening of the dovetail-shaped structure of 2 mm.

When paving the expansion reinforcing plates, the special expansion reinforcing connecting strip A is firstly placed in the special expansion reinforcing connecting strip assembling groove structure of each of the plates. When continue paving, the special expansion reinforcing connecting strip B is pre-inserted into the special expansion reinforcing connecting strip assembling groove structure of one plate, and the adjacent another plate is effectively spliced with the previous one through its special expansion reinforcing connecting strip assembling groove structure and special expansion reinforcing connecting strip. Finally, both the expansion reinforcing connecting strips A of the adjacent plates contact with the expansion reinforcing connecting strip B to expand and fix with each other, so that the two adjacent plates are effectively connected. The operation time for expansion and fixation after the contact between the expansion reinforcing connecting strip A and the expansion reinforcing connecting strip B is 8 minutes for basic curing, which reaches the final use strength after 24 hours. The tensile strength is 1.8 kN/m.

Example 6

Figure 9A:
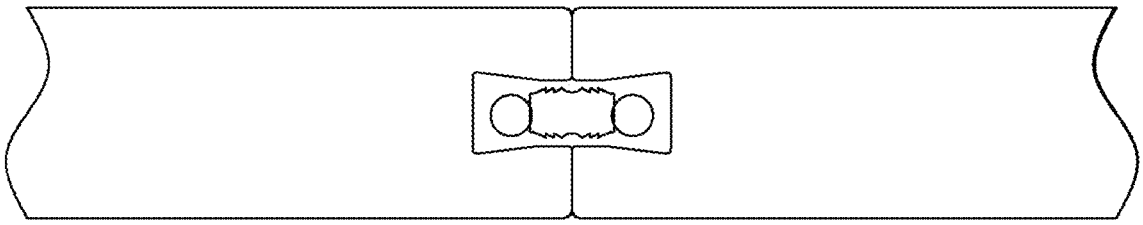
Figure 9B:
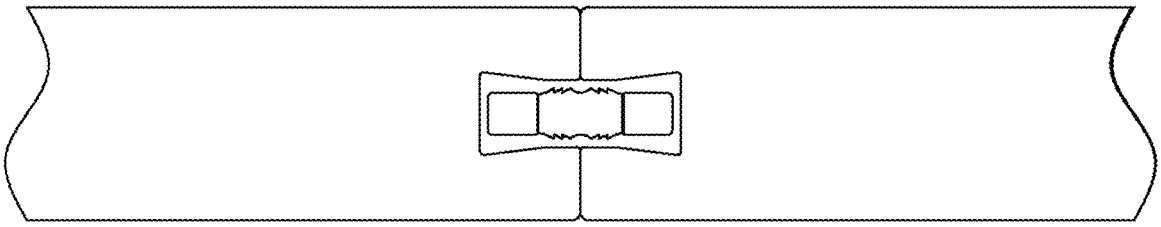
Figure 9C:
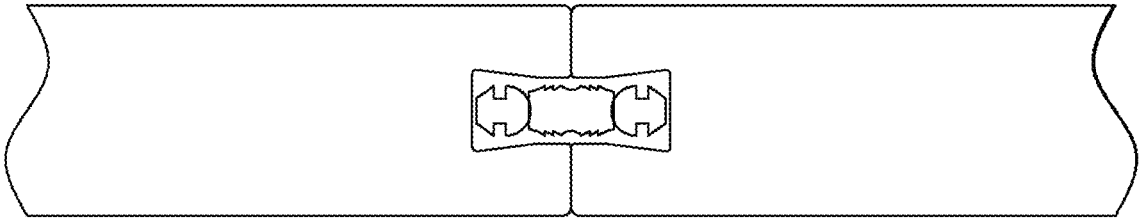

As shown in FIGS. 9A-9C, different from Example 1, in the example, an expansion reinforcing plate mainly includes a plate and a plate paving foundation layer, and further includes an elastic inserting strip assembling structure. The elastic inserting strip assembling structure includes a special expansion reinforcing connecting strip A, a special expansion reinforcing connecting strip B and a special expansion reinforcing connecting strip assembling groove structure disposed at the plates. The elastic inserting strip assembling structure is disposed at the edge of the plate.

The formula of the special expansion reinforcing connecting strip A included:

27 wt. % of low viscosity epoxy resin, 12 wt. % of active diluent, 36 wt. % of polyepoxy acrylate resin, and 25 wt. % of modified polyacrylic acid resin.

The production process of the special expansion reinforcing connecting strip A included the following steps:

Various materials in the formula were pre-heated and mixed at 125° C., and then were cold mixed at 45° C. to obtain a mixture. The mixed mixture was extruded at 175° C. by using a single screw extruder into a flexible connecting strip A with a certain shape.

The formula of the special expansion reinforcing connecting strip B included:

22 wt. % of polyamine, 42 wt. % of modified polyacrylic acid resin, 18 wt. % of low viscosity epoxy resin, 11 wt. % of active diluent, and 7 wt. % of ethyl acetate.

The production process of the special expansion reinforcing connecting strip B included the following steps:

Various materials in the formula were pre-heated and mixed at 118° C., and then were cold mixed at 40° C. to obtain a mixture. The mixed mixture was extruded at 161° C. by using a single screw extruder into a flexible connecting strip B with a certain shape.

In the example, the special expansion reinforcing connecting strip assembling groove structure is a dovetail-shaped structure with a length of 20 mm and a width at the opening of the dovetail-shaped structure of 8 mm, and the special expansion reinforcing connecting strip B is an irregular structure with a length of 25 mm and a width of 9 mm. Specifically, as shown in FIG. 9A, the cross-section of the special expansion reinforcing connecting strip A is a circular structure with a diameter of 2-15 mm. Different from FIG. 9A, as shown in FIG. 9B, the cross-section of the special expansion reinforcing connecting strip A is a rectangular structure with a length of 2-25 mm and a width of 0.5-10 mm. Different from FIG. 9A, as shown in FIG. 9C, the cross-section of the special expansion reinforcing connecting strip A is an irregular structure, and a maximum size of the outer edge of the irregular structure is as follows: a maximum length c1 of 2-25 mm and a maximum width of 0.5-10 mm.

When paving the expansion reinforcing plates, the special expansion reinforcing connecting strip A is firstly placed in the special expansion reinforcing connecting strip assembling groove structure of each of the plates. When continue paving, the special expansion reinforcing connecting strip B is pre-inserted into the special expansion reinforcing connecting strip assembling groove structure of one plate, and the adjacent another plate is effectively spliced with the previous one through its special expansion reinforcing connecting strip assembling groove structure and special expansion reinforcing connecting strip. Finally, both the expansion reinforcing connecting strips A of the adjacent plates contact with the expansion reinforcing connecting strip B to expand and fix with each other, so that the two adjacent plates are effectively connected. The operation time for expansion and fixation after the contact between the expansion reinforcing connecting strip A and the expansion reinforcing connecting strip B is 2 minutes for basic curing, which reaches the final use strength after 12 hours. The tensile strength is 1.6 kN/m.

Example 7

Figure 10A:
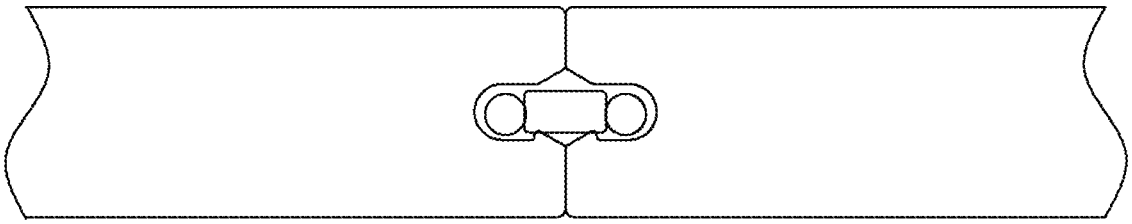
Figure 10B:
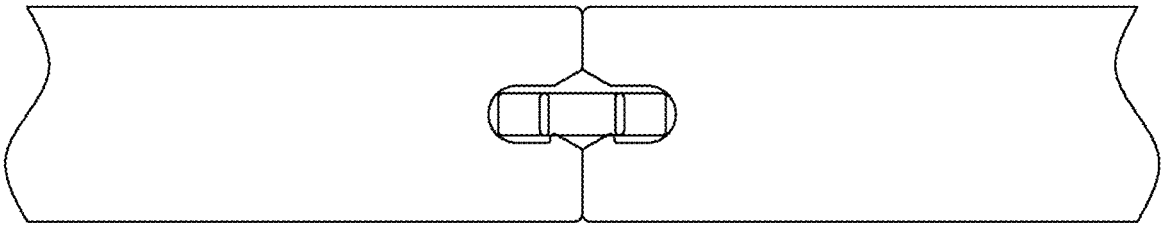
Figure 10C:
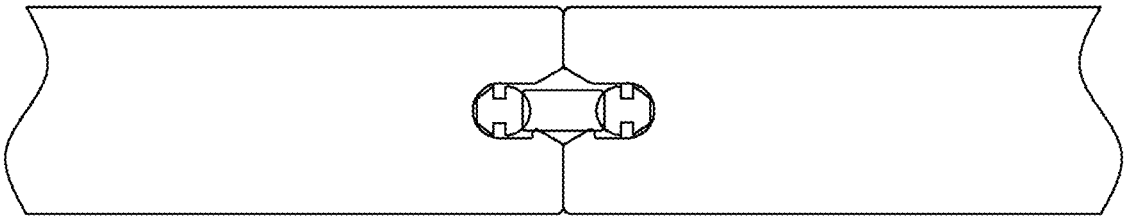

As shown in FIGS. 10A-10C, different from Example 1, in the example, an expansion reinforcing plate mainly includes a plate and a plate paving foundation layer, and further includes an elastic inserting strip assembling structure. The elastic inserting strip assembling structure includes a special expansion reinforcing connecting strip A, a special expansion reinforcing connecting strip B and a special expansion reinforcing connecting strip assembling groove structure disposed at the plates. The elastic inserting strip assembling structure is disposed at the edge of the plate.

The formula of the special expansion reinforcing connecting strip A included:

20 wt. % of low viscosity epoxy resin, 10 wt. % of active diluent, 60 wt. % of polyepoxy acrylate resin, and 10 wt. % of modified polyacrylic acid resin.

The production process of the special expansion reinforcing connecting strip A included the following steps:

Various materials in the formula were pre-heated and mixed at 125° C., and then were cold mixed at 45° C. to obtain a mixture. The mixed mixture was extruded at 175° C. by using a single screw extruder into a flexible connecting strip A with a certain shape.

The formula of the special expansion reinforcing connecting strip B included:

15 wt. % of polyamine, 49 wt. % of modified polyacrylic acid resin, 17 wt. % of low viscosity epoxy resin, 9 wt. % of active diluent, and 10 wt. % of ethyl acetate.

The production process of the special expansion reinforcing connecting strip B included the following steps:

Various materials in the formula were pre-heated and mixed at 118° C., and then were cold mixed at 40° C. to obtain a mixture. The mixed mixture was extruded at 161° C. by using a single screw extruder into a flexible connecting strip B with a certain shape.

In the example, the special expansion reinforcing connecting strip assembling groove structure is an irregular structure (i.e., a special-shaped structure) with a length of 20 mm and a width at the opening of the irregular structure of 8 mm, and the special expansion reinforcing connecting strip B is a rectangle structure with a length of 25 mm and a width of 10 mm. Specifically, as shown in FIG. 10A, the cross-section of the special expansion reinforcing connecting strip A is a circular structure with a diameter of 15 mm. Different from FIG. 10A, as shown in FIG. 10B, the cross-section of the special expansion reinforcing connecting strip A is a rectangular structure with a length of 25 mm and a width of 10 mm. Different from FIG. 10A, as shown in FIG. 10C, the cross-section of the special expansion reinforcing connecting strip A is an irregular structure, and a maximum size of the outer edge of the irregular structure is as follows: a maximum length c1 of 25 mm and a maximum width of 10 mm.

When paving the expansion reinforcing plates, the special expansion reinforcing connecting strip A is firstly placed in the special expansion reinforcing connecting strip assembling groove structure of each of the plates. When continue paving, the special expansion reinforcing connecting strip B is pre-inserted into the special expansion reinforcing connecting strip assembling groove structure of one plate, and the adjacent another plate is effectively spliced with the previous one through its special expansion reinforcing connecting strip assembling groove structure and special expansion reinforcing connecting strip. Finally, both the expansion reinforcing connecting strips A of the adjacent plates contact with the expansion reinforcing connecting strip B to expand and fix with each other, so that the two adjacent plates are effectively connected. The operation time for expansion and fixation after the contact between the expansion reinforcing connecting strip A and the expansion reinforcing connecting strip B is 3 minutes for basic curing, which reaches the final use strength after 15 hours. The tensile strength is 1.4 kN/m.

Example 8

Figure 11A:
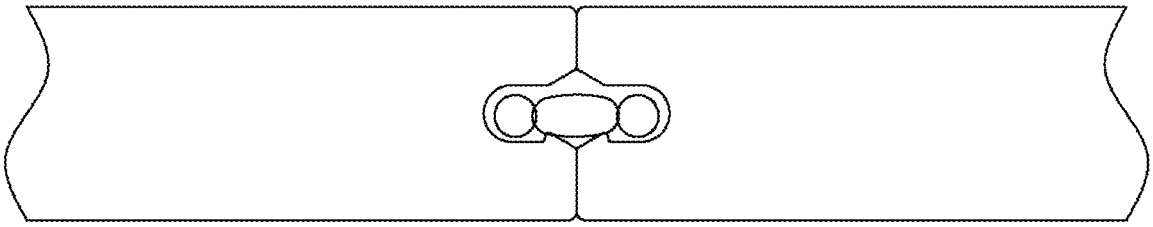
Figure 11B:
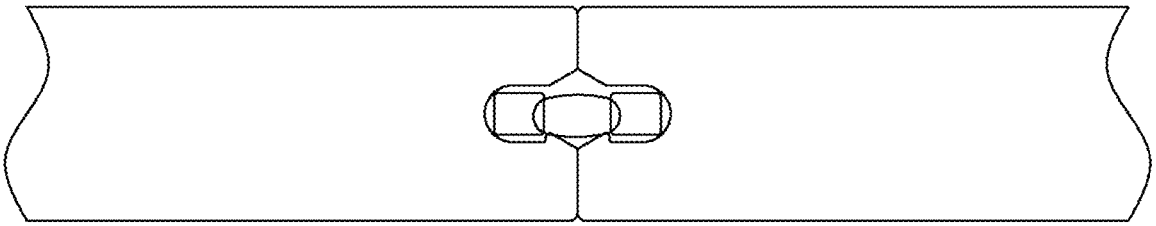
Figure 11C:
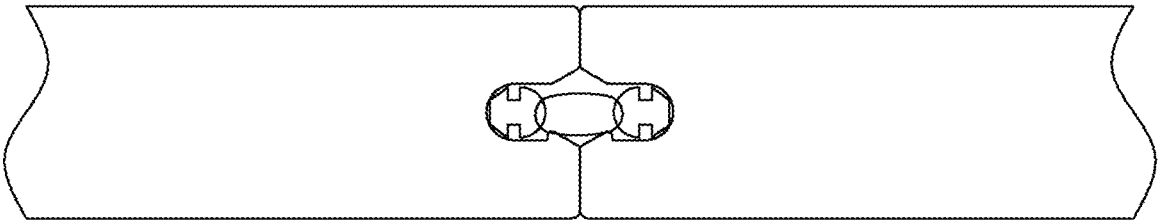

As shown in FIGS. 11A-11C, different from Example 1, in the example, an expansion reinforcing plate mainly includes a plate and a plate paving foundation layer, and further includes an elastic inserting strip assembling structure. The elastic inserting strip assembling structure includes a special expansion reinforcing connecting strip A, a special expansion reinforcing connecting strip B and a special expansion reinforcing connecting strip assembling groove structure disposed at the plates. The elastic inserting strip assembling structure is disposed at the edge of the plate.

The formula of the special expansion reinforcing connecting strip A included:

35 wt. % of low viscosity epoxy resin, 20 wt. % of active diluent, 35 wt. % of polyepoxy acrylate resin, and 10 wt. % of modified polyacrylic acid resin.

The production process of the special expansion reinforcing connecting strip A included the following steps:

Various materials in the formula were pre-heated and mixed at 125° C., and then were cold mixed at 45° C. to obtain a mixture. The mixed mixture was extruded at 175° C. by using a single screw extruder into a flexible connecting strip A with a certain shape.

The formula of the special expansion reinforcing connecting strip B included:

26 wt. % of polyamine, 42 wt. % of modified polyacrylic acid resin, 19 wt. % of low viscosity epoxy resin, 8 wt. % of active diluent, and 5 wt. % of ethyl acetate.

The production process of the special expansion reinforcing connecting strip B included the following steps:

Various materials in the formula were pre-heated and mixed at 118° C., and then were cold mixed at 40° C. to obtain a mixture. The mixed mixture was extruded at 161° C. by using a single screw extruder into a flexible connecting strip B with a certain shape.

In the example, the special expansion reinforcing connecting strip assembling groove structure is an irregular structure (i.e., a special-shaped structure) with a length of 11 mm and a width at the opening of the irregular structure of 4 mm, and the special expansion reinforcing connecting strip B is an oblong structure with a length of 13 mm and a width of 5 mm. Specifically, as shown in FIG. 11A, the cross-section of the special expansion reinforcing connecting strip A is a circular structure with a diameter of 8.5 mm. Different from FIG. 11A, as shown in FIG. 11B, the cross-section of the special expansion reinforcing connecting strip A is a rectangular structure with a length of 13 mm and a width of 5 mm. Different from FIG. 11A, as shown in FIG. 11C, the cross-section of the special expansion reinforcing connecting strip A is an irregular structure, and a maximum size of the outer edge of the irregular structure is as follows: a maximum length c1 of 13 mm and a maximum width of 5 mm.

When paving the expansion reinforcing plates, the special expansion reinforcing connecting strip A is firstly placed in the special expansion reinforcing connecting strip assembling groove structure of each of the plates. When continue paving, the special expansion reinforcing connecting strip B is pre-inserted into the special expansion reinforcing connecting strip assembling groove structure of one plate, and the adjacent another plate is effectively spliced with the previous one through its special expansion reinforcing connecting strip assembling groove structure and special expansion reinforcing connecting strip. Finally, both the expansion reinforcing connecting strips A of the adjacent plates contact with the expansion reinforcing connecting strip B to expand and fix with each other, so that the two adjacent plates are effectively connected. The operation time for expansion and fixation after the contact between the expansion reinforcing connecting strip A and the expansion reinforcing connecting strip B is 5 minutes for basic curing, which reaches the final use strength after 20 hours. The tensile strength is 2.0 kN/m.

Example 9

Figure 12A:
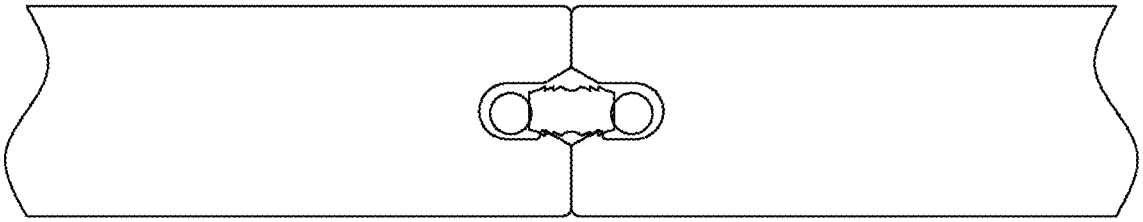
Figure 12B:
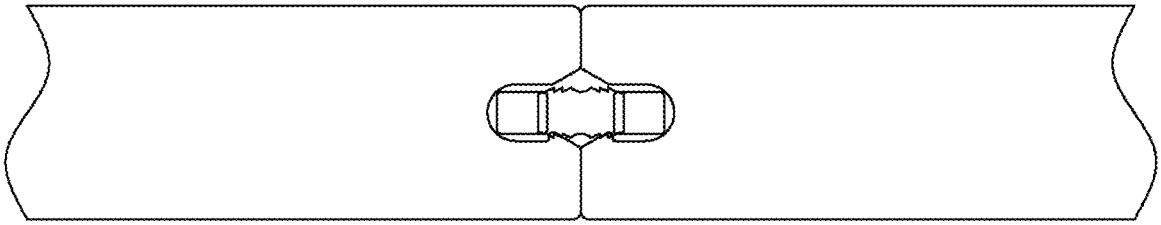
Figure 12C:
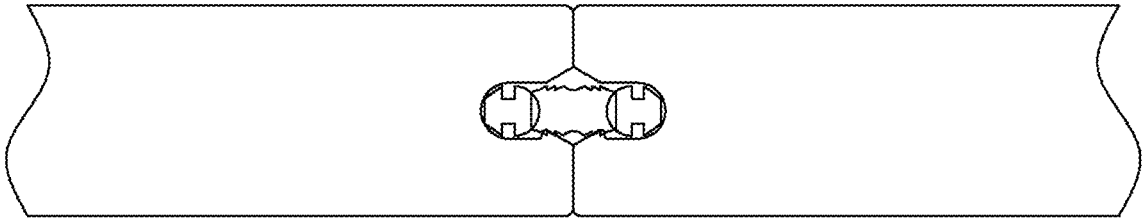

As shown in FIGS. 12A-12C, different from Example 1, in the example, an expansion reinforcing plate mainly includes a plate and a plate paving foundation layer, and further includes an elastic inserting strip assembling structure. The elastic inserting strip assembling structure includes a special expansion reinforcing connecting strip A, a special expansion reinforcing connecting strip B and a special expansion reinforcing connecting strip assembling groove structure disposed at the plates. The elastic inserting strip assembling structure is disposed at the edge of the plate.

The formula of the special expansion reinforcing connecting strip A included:

25 wt. % of low viscosity epoxy resin, 10 wt. % of active diluent, 45 wt. % of polyepoxy acrylate resin, and 20 wt. % of modified polyacrylic acid resin.

The production process of the special expansion reinforcing connecting strip A included the following steps:

Various materials in the formula were pre-heated and mixed at 125° C., and then were cold mixed at 45° C. to obtain a mixture. The mixed mixture was extruded at 175° C. by using a single screw extruder into a flexible connecting strip A with a certain shape.

The formula of the special expansion reinforcing connecting strip B included:

22 wt. % of polyamine, 42 wt. % of modified polyacrylic acid resin, 18 wt. % of low viscosity epoxy resin, 10 wt. % of active diluent, and 7 wt. % of ethyl acetate.

The production process of the special expansion reinforcing connecting strip B included the following steps:

Various materials in the formula were pre-heated and mixed at 118° C., and then were cold mixed at 40° C. to obtain a mixture. The mixed mixture was extruded at 161° C. by using a single screw extruder into a flexible connecting strip B with a certain shape.

In the example, the special expansion reinforcing connecting strip assembling groove structure is an irregular structure (i.e., a special-shaped structure) with a length of 2 mm and a width at the opening of the irregular structure of 0.5 mm, and the special expansion reinforcing connecting strip B is an irregular structure (i.e., a special-shaped structure) with a length of 2 mm and a width at the opening of the irregular structure of 0.5 mm. Specifically, as shown in FIG. 12A, the cross-section of the special expansion reinforcing connecting strip A is a circular structure with a diameter of 2 mm. Different from FIG. 12A, as shown in FIG. 12B, the cross-section of the special expansion reinforcing connecting strip A is a rectangular structure with a length of 2 mm and a width of 0.5 mm. Different from FIG. 12A, as shown in FIG. 12C, the cross-section of the special expansion reinforcing connecting strip A is an irregular structure, and a maximum size of the outer edge of the irregular structure is as follows: a maximum length c1 of 2 mm and a maximum width of 0.5 mm.

When paving the expansion reinforcing plates, the special expansion reinforcing connecting strip A is firstly placed in the special expansion reinforcing connecting strip assembling groove structure of each of the plates. When continue paving, the special expansion reinforcing connecting strip B is pre-inserted into the special expansion reinforcing connecting strip assembling groove structure of one plate, and the adjacent another plate is effectively spliced with the previous one through its special expansion reinforcing connecting strip assembling groove structure and special expansion reinforcing connecting strip. Finally, both the expansion reinforcing connecting strips A of the adjacent plates contact with the expansion reinforcing connecting strip B to expand and fix with each other, so that the two adjacent plates are effectively connected. The operation time for expansion and fixation after the contact between the expansion reinforcing connecting strip A and the expansion reinforcing connecting strip B is 10 minutes for basic curing, which reaches the final use strength after 30 hours. The tensile strength is 2.4 kN/m.

Finally, it should be noted that the above embodiments are only used to illustrate the technical solutions of the present invention, but not to limit them; although the present invention has been described in detail with reference to the foregoing embodiments, those ordinarily skilled in the art should understand that: the technical solutions described in the foregoing embodiments can still be modified, or some or all of the technical features thereof can be equivalently replaced; and these modifications or replacements do not make the essence of the corresponding technical solutions deviate from the scope of the technical solutions of the embodiments of the present invention.

The invention claimed is:

1. An expansion reinforcing plate, comprising a first plate and a second plate that are adjacent to each other, a first expansion reinforcing connecting strip, a second expansion reinforcing connecting strip, and a third expansion reinforcing connecting strip, wherein the first plate has a first groove disposed at an edge thereof, the second plate has a second groove disposed at an edge thereof, and the first and the second grooves are aligned with each other and form an expansion reinforcing connecting strip assembling groove structure, wherein, in the expansion reinforcing connecting strip assembling groove structure, the first expansion reinforcing connecting strip is disposed in the first groove, the second expansion reinforcing connecting strip is disposed in the second groove, and the third expansion reinforcing connecting strip is disposed between and in contact with the first and the second expansion reinforcing connecting strips, wherein the third expansion reinforcing connecting strip reacts with the first and the second expansion reinforcing connecting strips so as to expand in the expansion reinforcing connecting strip assembling groove structure, and whereby fixedly connecting the first plate and the second plate together, wherein each of the first and the second expansion reinforcing connecting strip comprises 15-35 wt. % of low viscosity epoxy resin, 5-20 wt. % of active diluent, 35-60 wt. % of polyepoxy acrylate resin, and 10-25 wt. % of modified polyacrylic acid resin, and wherein the low viscosity epoxy resin is at least one selected from the group consisting of E-54 bisphenol A epoxy resin, E-51 bisphenol A epoxy resin, and REF170 bisphenol F epoxy resin having a viscosity lower than 1 Pa·s.

2. The expansion reinforcing plate according to claim 1, further comprising additional plates, wherein the first, the second, and the additional plates are of the same structure and are fixed connected to form the expansion reinforcing plate.

3. The expansion reinforcing plate according to claim 1, wherein each of the first and the second expansion reinforcing connecting strip is prepared according to a process that comprises:

adding 15-35 wt. % of the low viscosity epoxy resin, 30-50 wt. % of the polyepoxy acrylate resin and 5-35 wt. % of the modified polyacrylic acid resin into 5-20 wt. % of the active diluent to obtain a mixture;

preheating and mixing the mixture at 110-135° C.;

cold mixing the mixture at 35-50° C.; and extruding the mixture at 165-210° C. by using a single screw extruder to obtain each of the first and the second expansion reinforcing connecting strip.

4. The expansion reinforcing plate according to claim 1, wherein the third expansion reinforcing connecting strip comprises 15-35 wt. % of polyamine, 50-70 wt. % of the modified polyacrylic acid resin, 5-25 wt. % of the low viscosity epoxy resin, 5-15 wt. % of the active diluent, and 5-20 wt. % of ethyl acetate.

5. The expansion reinforcing plate according to claim 1, wherein the third expansion reinforcing connecting strip is prepared according to a process that comprises:

preheating and mixing 15-35 wt. % of the polyamine, 50-70 wt. % of the modified polyacrylic acid resin, 5-25 wt. % of the low viscosity epoxy resin, 5-15 wt. % of the active diluent and 5-20 wt. % of ethyl acetate at 110-135° C. to obtain a mixture;

cold mixing the mixture at 35-50° C.; and extruding the mixture at 150-200° C. by using a single screw extruder to obtain the third expansion reinforcing connecting strip.

6. The expansion reinforcing plate according to claim 1, wherein each of the first and the second expansion reinforcing connecting strip has a rectangular cross-sectional area, or a circular cross-sectional area, wherein the rectangular cross-sectional area has a length (a1) of 2-25 mm and a width (h1) of 0.5-10 mm, and the circular cross-sectional area has a diameter (R1) of 2-15 mm.

7. The expansion reinforcing plate according to claim 1, wherein the third expansion reinforcing connecting strip has a rectangular cross-sectional area, or an oblong cross-sectional area, wherein the rectangular cross-sectional area has a length (d1) of 2-25 mm and a width (e1) of 0.5-10 mm, and the oblong structure has a length (d2) of 2-25 mm and a width (e2) of 0.5-10 mm.

8. The expansion reinforcing plate according to claim 1, wherein the expansion reinforcing connecting strip assembling groove structure has a U-shaped structure, or a dovetail-shaped structure, wherein the U-shaped structure has a length (f1) of 2-20 mm and a width (g1) of 0.5-8 mm, and the dovetail-shaped structure has a length (f2) of 2-20 mm and a width (g2) at an opening thereof of 0.5-8 mm.

* * * * *